US006788764B2

(12) United States Patent
Saladin et al.

(10) Patent No.: US 6,788,764 B2
(45) Date of Patent: Sep. 7, 2004

(54) ADJUSTABLE COLLIMATOR AND METHOD

(75) Inventors: Jean-Pierre Saladin, Bagneux (FR); Serge Louis Muller, Guyancourt (FR); Luc Gabriel Miotti, Vanves (FR)

(73) Assignee: GE Medical Systems Global Technology Company LLC, Waukesha, WI (US)

( * ) Notice: Subject to any disclaimer, the term of this patent is extended or adjusted under 35 U.S.C. 154(b) by 408 days.

(21) Appl. No.: 10/034,013

(22) Filed: Dec. 19, 2001

(65) Prior Publication Data

US 2002/0126799 A1 Sep. 12, 2002

(51) Int. Cl.[7] ..... G21K 1/04
(52) U.S. Cl. ..... 378/152; 378/150
(58) Field of Search ..... 378/147, 150–152

(56) References Cited

U.S. PATENT DOCUMENTS 3,668,402 A * 6/1972 Palermo et al. ..... 378/150
4,450,578 A * 5/1984 Hill ..... 378/152
5,172,402 A * 12/1992 Mizusawa et al. ..... 378/34

* cited by examiner

*Primary Examiner*—Craig E. Church
(74) *Attorney, Agent, or Firm*—Jay L. Chaskan; Cantor Colburn LLP

(57) ABSTRACT

A collimator for X-ray apparatus has an aperture defined by the edges of four movable flexible shutters. Each shutter can be moved independently of the other shutters; thus, the position and the size of the aperture can be adjusted at will. The shutters are moved by winding them onto drums; each drum is driven by a stepping motor. Springs bias the shutters towards the closed position of the collimator.

24 Claims, 2 Drawing Sheets

ADJUSTABLE COLLIMATOR AND METHOD

CROSS REFERENCE TO RELATED APPLICATIONS

This application claims the benefit of a priority under 35 USC 119 to French Patent Application No. 00 16584 filed Dec. 19, 2000, the entire contents of which are incorporated by reference.

BACKGROUND OF THE INVENTION

The invention relates to radiation equipment, such as X-ray radiation apparatus, and more particularly to a collimator intended for use in such apparatus.

In X-ray apparatus, radiation is emitted from one point on a source. The radiation takes the form of a cone directed towards an object to be examined or towards an X-ray sensitive sensor—for example a photographic plate or a digital sensing means. The cone generally has crosswise dimensions which are greater than the dimensions of the object to be examined or the sensitive means. The collimator is a device which is placed between the source and the object to be examined, allowing a part of the X-rays to be blocked off whereby radiation is only applied to the object to be examined inside an examination region or in the region corresponding to the sensor. The collimator is adjustable to allow different examinations.

Such a collimator is disclosed in U.S. Pat. No. 3,668,402. In that patent, the collimator is constituted by two web assemblies opaque to X-rays. Each web assembly has a pair of spaced and connected webs which form a continuous loop reaved over a pair of drums. The two assemblies are arranged one above the other, with the drums perpendicular to each other. The facing edges of the webs of one assembly define the facing edges of a rectangular opening through which X-rays can pass. The edges of the webs of the other assembly define the other two edges of the rectangular opening. The collimator is adjusted in order to vary aperture size by causing one of the assemblies to roll using the drums. The facing edges of the webs of an assembly are consequently brought closer together or further apart.

This collimator has the disadvantage of not making it possible to obtain an asymmetric aperture. Rotation of a web assembly causes simultaneous displacement in the opposite direction and through the same distance, of the facing edges of the collimator opening. The opening is consequently always symmetric with respect to an axis of the conical X-ray beam. Additionally, the collimator is larger than maximum aperture size. In a position of maximum collimator aperture, the edges of a given web overlap and the web extends between the pair of drums.

There is consequently a need for a collimator the aperture of which can be adjusted asymmetrically. Such an asymmetric aperture is notably useful for mammography. In effect, in such apparatus, it is difficult to readily move the organ to be examined and to ensure that it is systematically well positioned on the axis of the X-ray beam.

BRIEF DESCRIPTION OF THE INVENTION

In an embodiment of the present invention, a collimator has four flexible shutters defining the edges of the collimator aperture. Each shutter can be moved independently of the other shutters.

In this structure, the position of each edge of the aperture can be adjusted independently. Using this collimator, an asymmetric aperture can be obtained. The collimator aperture can be adapted to the object or organ to be examined while limiting radiation outside the object or organ. It is not necessary for the object or organ to be placed directly on the axis of the X-ray beam.

DETAILED DESCRIPTION OF THE INVENTION

Figure 1:
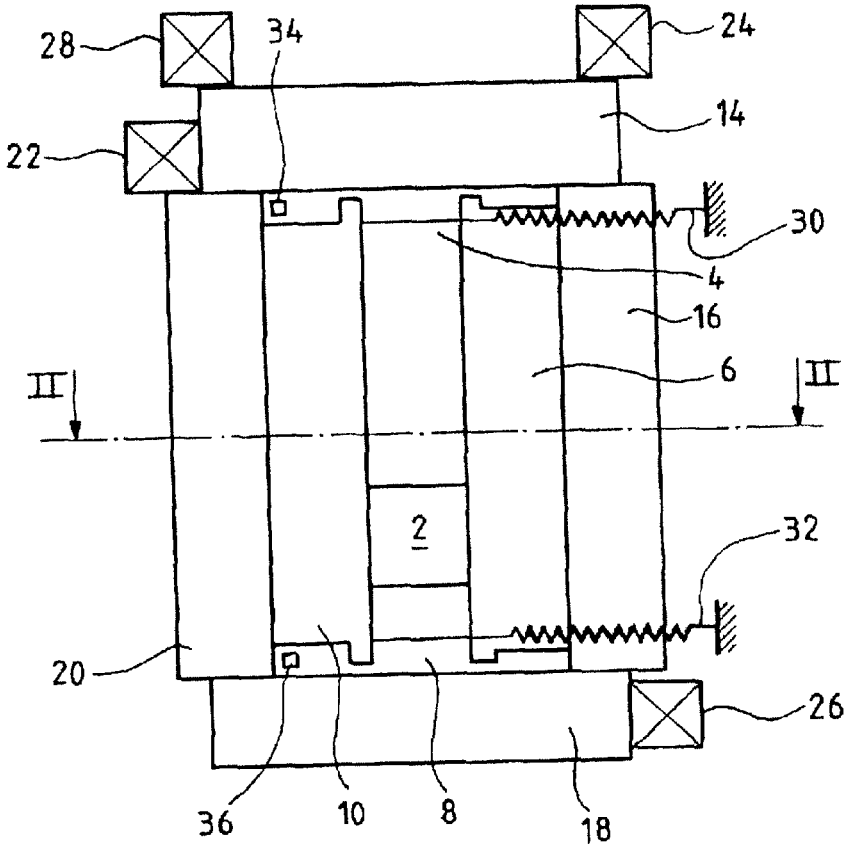
FIG. 1 is a top view of a collimator.
Figure 2:
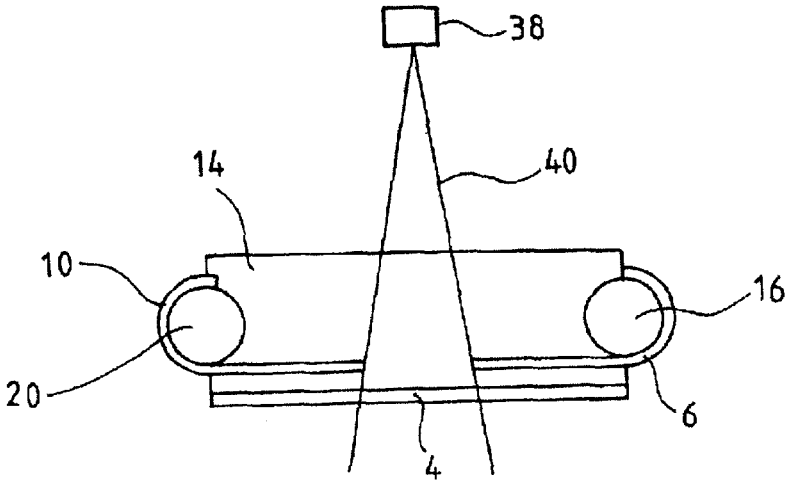
FIG. 2 is a cross-sectional view of the collimator in FIG. 1.

A collimator according to one embodiment of the invention is shown in FIGS. 1 and 2. The collimator has an aperture or collimated region 2 through which the X-rays pass. The aperture has a rectangular shape. The dimensions of the rectangle can be adjusted. Additionally, each side of the rectangle can be moved independently of the other sides of the rectangle. The collimator has four flexible shutters 4, 6, 8 and 10. The shutters are made of a material which is opaque to the radiation. The material is also flexible, in other words, can be wound onto a drum or roller, as explained below. For the material, a metallic foil can be used or, alternatively, a synthetic rubber material that includes a metal filler. The side or edge of a shutter constitutes an edge of the collimator aperture. Edge 12 of shutter 4 forms the upper edge of the collimator aperture.

Each shutter 4, 6, 8 or 10 is wound onto a respective drum 14, 16, 18 or 20 which extends substantially parallel to the edge of the shutter. The drum and the edge of a shutter are parallel ensures that the outer dimensions of the collimator are as close as possible to maximum aperture size. Each drum is driven in rotation independently. In the embodiment shown, a motor 22, 24, 26 or, respectively 28 is provided for each drum 14, 16, 18 or 20. The motor is for example a stepping motor which drives the drum to which t is connected in rotation. As each drum has its own separate motor, each one of the shutters of a collimator can be moved independently. The collimator aperture can have any desired size and be located at any desired position within the space defined between the drums. In the example of FIG. 1, the collimator is symmetrical in the horizontal direction: the vertical axis of symmetry of the aperture is at the mid-point between drums 16 and 20. As against this, the collimator is not symmetrical in the vertical direction. The horizontal axis of symmetry of the aperture is not at the mid-point between drums 14 and 18, but is closer to drum 18 than it is to drum 14. It is consequently possible to move the collimator aperture downwards while maintaining a constant degree of aperture opening. This has the following advantage in examination equipment. The patient or object to be examined can be positioned in the analysis field without concern for their position with respect to the beam axis. Then, collimator aperture can be adapted to the organ without moving the latter. In the example of FIG. 1, the organ is located towards the bottom, closer to drum 18 than to drum 14, and the collimator aperture is displaced downwards. It is not necessary to raise shutter 4 when shutter 8 descends. Less radiation is applied to the patient.

In the example of FIG. 1, springs can be provided which bias facing shutters towards each other. Such springs 30, 32 are shown diagrammatically in FIG. 1 for shutter 10. The springs for the other shutters are not shown. The presence of the springs constitutes a safety feature for the collimator should the drum motors fail or stop, opposing shutters come into contact with each other and the collimator is closed. The collimator consequently closes should there be a problem with the shutter motors. The springs also take up any possible slack resulting from winding of the shutters. The springs shown by way of example in the drawing are tensioned when the shutters are wound onto the drums. Springs which are compressed during winding of the shutters could also be provided.

The collimator shown in FIG. 1 operates as follows. In order to define an aperture of given size and position, the motors are operated. Each shutter is wound onto its drum as a function of the desired position of the corresponding edge of collimator aperture 2. Calibration can be performed at the manufacturing stage of the collimator by constituting a table of shutter positions and motor stopping points. It is also possible to proceed with initializing collimator shutter positions by completely opening the collimator, in other words fully winding each shutter. An abutment can be provided for limiting shutter winding such as the stops 34, 36 for shutter 10 in the example of FIG. 1. In this case, winding of the shutters to the position of maximum opening brings them to a determined position, the position being fully determined by the abutment stops. The degree of unwinding of the shutters from this determined position provides an accurate indication of shutter position. Further, where digital sensing means are used for receiving the image, shutter position can be registered on the image supplied. Shutter position can consequently be verified at each exposure.

FIG. 2 shows a cross section through the collimator in FIG. 1 along the line II—II on FIG. 1. This plane is a plane parallel to drums 14 and 18, intersecting drums 16 and 20. Those parts already described with reference to FIG. 1 will be recognised on FIG. 2, e.g., the shutters and corresponding drums. FIG. 2 additionally shows that shutters 4 and 8 for the one part, and shutters 6 and 10 for the other part, are in different planes. FIG. 2 also shows the source of X-rays 38 as well as the portion 40 of the beam passing through the collimator aperture.

Figure 3:
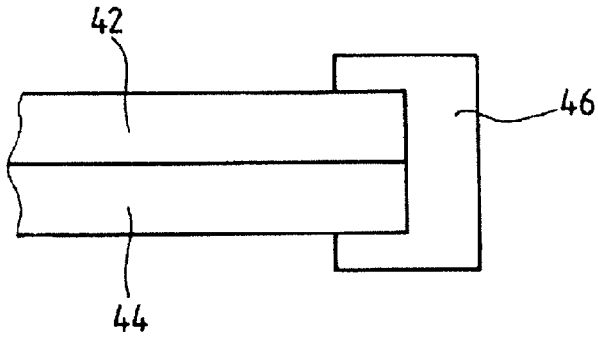
FIG. 3 is an enlarged view of the edge of a shutter in the collimator of FIG. 1.

FIG. 3 shows a cross section on an enlarged scale of the edge of a shutter. Shutter 6 is constituted by two flexible sheets 42 and 44 placed one above the other. This arrangement is particularly advantageous when the shutter is a synthetic rubber material. In this case, there may be inclusions in the shutter, rendering it transparent to X rays The presence of two superimposed layers decreases the probability of the shutter having a point of transparency. It is indeed highly unlikely that inclusions in both layers will be exactly superimposed. FIG. 3 also shows that an insert or additional part 46 is provided on the edge of the shutter. This part can be in a material opaque to X-rays such as a metal material. Its presence ensures, firstly, a sharp edge for the X-ray image independently of the number of layers making up the shutter. Where the shutter consists of two layers, the part also helps to keep the layers together. It can also be used to anchor the springs of the type mentioned with reference to FIG. 1.

Figure 4:
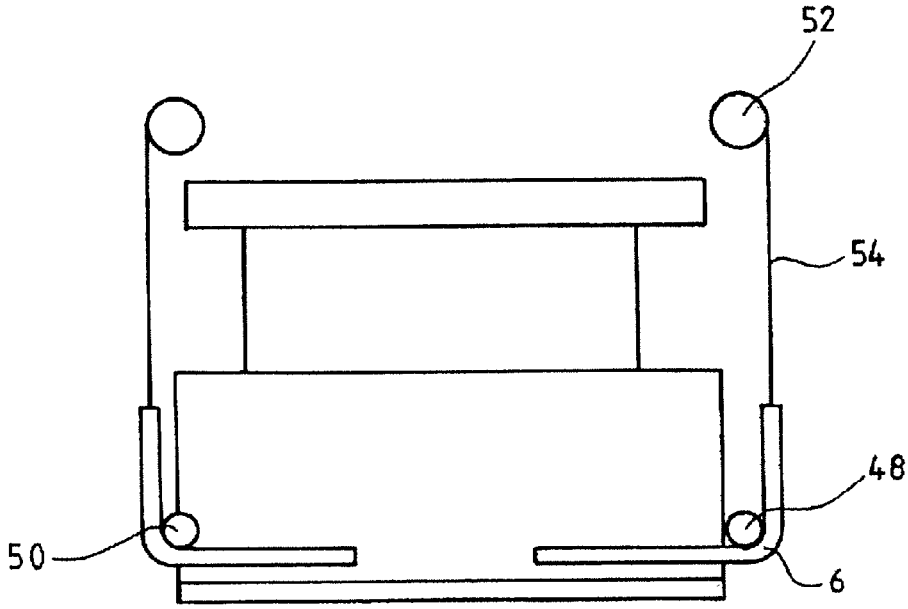
FIG. 4 is a cross section through another collimator.

FIG. 4 shows a cross section through another example of a collimator. The collimator in FIG. 4 differs from the one in FIGS. 1–3 in that the shutters are not wound directly onto the drums. In the example of FIG. 4, rollers 48 and 50 are provided in place of the drums. Shutter 6 is not wound onto roller 48 but simply bears thereon during its travel towards drum 52. In this example, the drums providing winding of the shutters are no longer close to the plane of the shutters, but can be in a plane that is offset with respect to the shutter plane. The advantages of the example in FIG. 4 are as follows. Firstly, the rollers take up less space than the drums. In this way, for a given collimator aperture, the transverse dimensions of a collimator are smaller than in the example of FIGS. 1 and 2. Secondly, as FIG. 4 shows, it is not necessary for the shutters to be wound onto the drums. It can be sufficient to use transmission members such as wires 54, which are secured to the shutters and wind onto the drums. This example consequently limits the torsion to which the shutters are subject. It is now possible to employ drums with an outside diameter smaller than that shown in the example of FIGS. 1 and 2. In this example, like in the example of FIGS. 1 and 2, the drums are provided to drive the shutters and allow each shutter to be moved individually.

FIGS. 1 and 2 show a rectangular aperture. A trapezium-shaped aperture or one having a diamond shape could also be provided by inclining the drums with respect to each other. The collimator in the disclosed embodiments applies to X-ray apparatus but can also be used with apparatus delivering other types of radiation. The drive examples shown on the one hand in FIGS. 1 and 2 and on the other hand in FIG. 4 can be mixed. In this case, some of the shutters are wound directly onto the drums while others are driven by the drums via rollers.

Various modifications in structure and/or steps and/or function may be made by one skilled in the art without departing from the scope and extent of the invention as recited in the claims.

What is claimed is:

1. A collimator having an aperture defined by the edges of four movable flexible shutters each shutter being movable independently of the other shutters.

2. The collimator of claim 1 wherein the shutter is wound onto a drum.

3. The collimator of claim 1 wherein one of the shutters is linked by at least one transmission member which is wound onto a drum.

4. The collimator of claim 1 wherein one of the shutters is biased towards a facing shutter by resilient means.

5. The collimator of claim 2 wherein one of the shutters is biased towards a facing shutter by resilient means.

6. The collimator of claim 3 wherein one of the shutters is biased towards a facing shutter by resilient means.

7. The collimator of claim 1 in which a stop member limits the displacement of a shutter moving away from a facing shutter.

8. The collimator of claim 2 in which a stop member limits the displacement of a shutter moving away from a facing shutter.

9. The collimator of claim 3 in which a stop member limits the displacement of a shutter moving away from a facing shutter.

10. The collimator of claim 4 in which a stop member limits the displacement of a shutter moving away from a facing shutter.

11. The collimator of claim 1 in which a shutter comprises of two layers one above the other.

12. The collimator of claim 2 in which a shutter comprises of two layers one above the other.

13. The collimator of claim 3 in which a shutter comprises of two layers one above the other.

14. The collimator of claim 4 in which a shutter comprises of two layers one above the other.

15. The collimator of claim 7 in which a shutter comprises of two layers one above the other.

16. The collimator of claim 1 in which the edge of a shutter is provided with a metal part.

17. The collimator of claim 2 in which the edge of a shutter is provided with a metal part.

18. The collimator of claim 3 in which the edge of a shutter is provided with a metal part.

19. The collimator of claim 4 in which the edge of a shutter is provided with a metal part.

20. The collimator of claim 7 in which the edge of a shutter is provided with a metal part.

21. The collimator of claim 11 in which the edge of a shutter is provided with a metal part.

22. An apparatus having a radiation source and a collimator according to claim 1.

23. A method for collimating radiation from a source comprising the steps of:

providing a collimator having an aperture defined by the edges of four movable flexible shutters; and moving each shutter independently of the other shutters to adjust collimation aperture.

24. The method of claim 23 wherein the displacement step is preceded by a step in which a position of the collimator shutters is initialized, the initialization step comprising opening the shutters to a position where they encounter stop members.

* * * * *